US006039167A

United States Patent [19]

Vellinga

[11] Patent Number: 6,039,167

[45] Date of Patent: Mar. 21, 2000

[54] ESCALATOR STEP OR ELEMENT FOR SIDEWALK

[75] Inventor: Jan Vellinga, Hamburg, Germany

[73] Assignee: Thyssen Aufzüge GmbH

[21] Appl. No.: 09/088,548

[22] Filed: Jun. 1, 1998

Related U.S. Application Data

[60] Provisional application No. 60/056,714, Aug. 22, 1997.

[51] Int. Cl.[7] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 5,350,049 | 9/1994 | Ahis et al. | 198/333 |
| 5,358,089 | 10/1994 | Riedel | 198/333 |

FOREIGN PATENT DOCUMENTS

| | | |
|---|---|---|
| 0 771 756 | 5/1997 | European Pat. Off. . |
| 2518440 | 11/1976 | Germany . |
| 2717666 | 10/1978 | Germany . |
| 4134626 | 10/1991 | Germany . |
| 9222491 | 12/1992 | WIPO . |
| 9523758 | 9/1995 | WIPO . |

*Primary Examiner*—James R. Bidwell
*Attorney, Agent, or Firm*—Robert W. Becker & Associates

[57] ABSTRACT

A step for an escalator or an element for a moving sidewalk has a stepping surface with a plurality of stays and grooves extending in the travel direction of the escalator or the moving sidewalk. A reinforcement provided at the rearward edge of the stepping surface and extending transverse to the travel direction across the step is embodied as a truss structure. The step consists of a fiberglass-reinforced mixture of polycarbonate and polyethylene terephthalate.

15 Claims, 2 Drawing Sheets

ESCALATOR STEP OR ELEMENT FOR SIDEWALK

This application claims benefit of Provisional Application No. 60/056,714 filed Aug. 22, 1997.

BACKGROUND OF THE INVENTION

The invention relates to a step for an escalator or an element for a moving sidewalk.

Numerous attempts have been made to provide a step for an escalator or an element for a moving sidewalk with a sufficient stiffness while providing only a minimal amount of material. Especially for wide steps or elements which presently can have a width of a meter or more, the rearward portion of the stepping surface is especially critical with respect to stability.

On the other hand, steps for escalators and elements for moving sidewalks are produced in considerable numbers so that even a minimal reduction of their weight and material expenditure reduces the expenses for material but also may result optionally in weight reduction of the movable parts of the escalator or the moving sidewalk which is desirable for various reasons.

While aluminum injection molded steps exhibit material problems in regard to tension cracks, plastic steps have the additional problem that the step or element must be dimensionally stable whereby a minimal heat expansion coefficient is essential in order to ensure reliable operation without the step or element grinding or jamming when surpassing the specified tolerances.

A further problem is the manufacture of plastic steps because due to the preferred manufacturing method, i.e., injection molding, a heat shrinkage must be taken into consideration which, for known steps despite the already existing values gained from experience and respective corrective attempts, still causes a 30% reject rate.

Accordingly, different attempts have been made to improve the known steps or elements with respect to maintaining the required dimensions while ensuring minimal material expenditure and comparatively minimal manufacturing expenditure. For example, the steps according to WO 92/22491 and WO 95/23758 have, at the rearward end of the stepping surface, a reinforcement profile that may be embodied differently.

Such reinforcement profiles for aluminum steps are known from DE-OS 27 17 666 whereby these known solutions result in a comparatively great material expenditure or with respect to dimensional precision for temperature fluctuations, are unsatisfactory.

A comparable solution is also known from DE-PS 41 34 626 which has been used for defining the preamble. This known construction which, in practice, has proven successful, employs fiberglass-reinforced thermoplastic material for the unitary embodiment of the escalator step. This solution, however, for comparatively wide escalator steps has occasionally high tolerance, fluctuations especially when the different heat expansion coefficients of the under structure of the escalator of the fiberglass reinforced plastic with respect to the specified temperature range of the escalator is taken into consideration.

It is also known to stabilize the rearward portion of the escalator steps such that the rearward axle extends from end to end below the stepping surface. This is disclosed in DE-OS 25 18 440 which also relates to the use of plastic material. With this solution, the required stiffening can be achieved. However, it must be ensured that the axle relative to the plastic material of the step or of the element cannot slide, and, furthermore, this construction is rather complicated and also very heavy when employing steel axles.

It is therefore an object of the invention to provide a step or element for an escalator or a moving sidewalk according to the preamble of claim 1 which, with respect to stability in relation to material use in comparison to the prior art is beneficial, but comparatively inexpensively producible and also provides advantages with respect to dimensional stability for an expanded temperature range and with respect to the weight of the step or the element.

SUMMARY OF THE INVENTION

The invention relates to a step having a stepping surface with a plurality of stays and grooves extending in the direction of travel of the escalator or moving sidewalk. A reinforcement at the rearward edge of the stepping surface is embodied as a truss structure that extends transverse to the direction of travel across the steps or elements.

Surprisingly, the inventive combination of features not only results in a especially excellent dimensional stability at reduced weight. A comparatively thin-walled realization of the step or element is possible which results in corresponding material savings. However, the dimensional stability, and thus the reject rate, is considerably improved whereby surprisingly also the temperature sensitivity can be especially improved when a conventional truss structure, i.e., a truss structure with rectangular base design is used.

The manufacture can be realized not only in a material saving but also labor-reducing manner by employing known mold slides that can be introduced into the injection mold.

Despite the use of fiberglass-reinforced plastic material an inexpensive manufacture, for example, by injection molding or extrusion is possible whereby, surprisingly, the stiffness is not diminished in comparison to a higher fiberglass contents and, when using an optimal fiberglass contents of 30%, is even improved.

Surprisingly, the inventive measures result in only minimal distortion due to the combination of the truss structure with the special plastic material mixture so that the reject rate can be drastically reduced to values near 0%. The stiffness values are surprisingly better than when using U-shaped stiffening profiles and are at least as good as with employment of tubular profiles which must be produced relatively complicated by using slides introduced into the injection mold.

Apparently, the inventive truss structure design allows in combination with the inventive material selection, an especially minimal wall thickness fluctuation so that during cooling of the injection mold the heat shrinkage is made more uniform, on the one hand, and, on the other hand, decreases.

With respective insertion parts, an inexpensive manufacture can be realized whereby it is basically possible to retrofit a mold which is used for the manufacture of a solid part with respective insertion parts.

BRIEF DESCRIPTION OF THE DRAWINGS

Further details, advantages, and features result from the following description of an embodiment with the aid of the drawing.

It is shown in.

DESCRIPTION OF PREFERRED EMBODIMENTS

Figure 1:
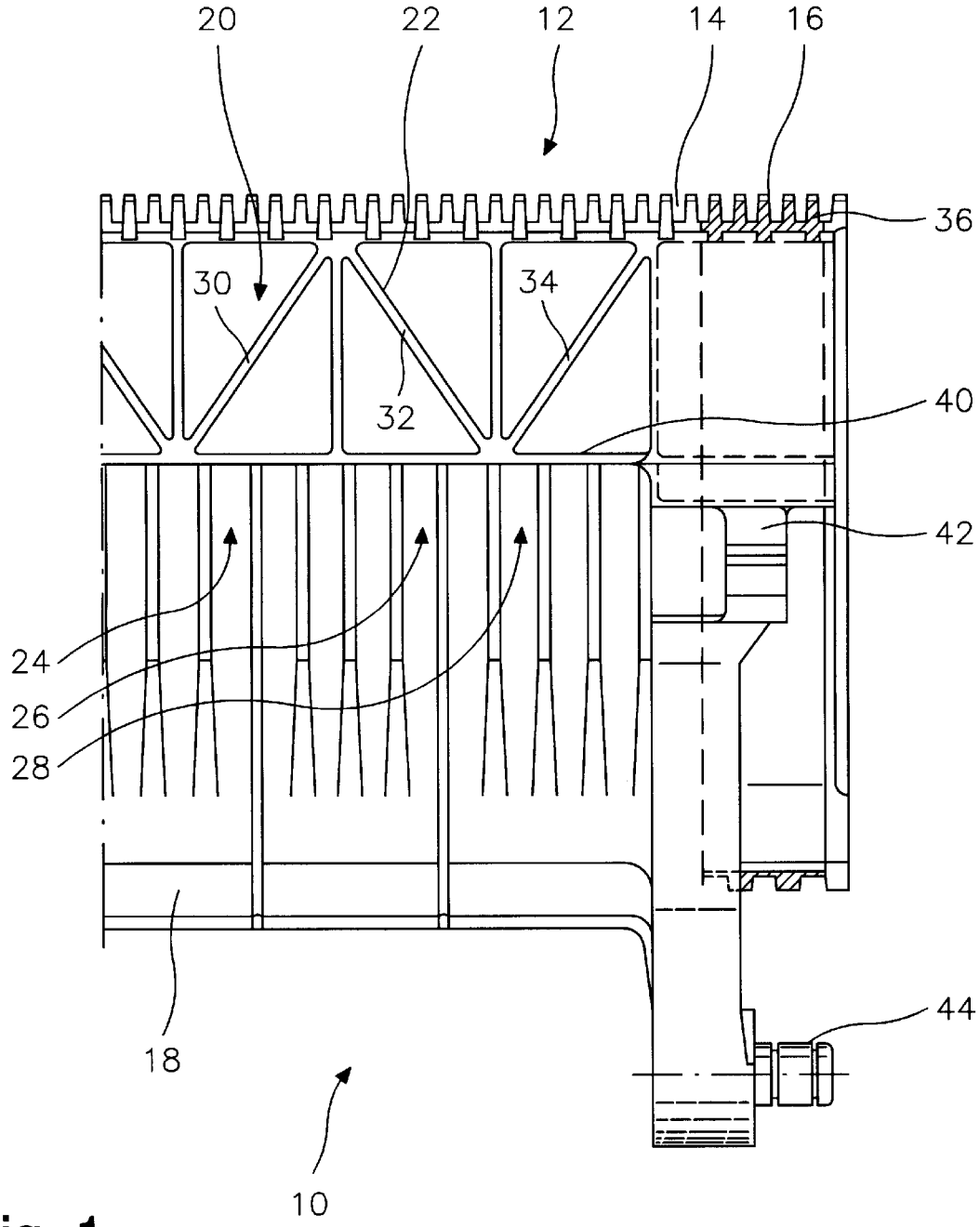
FIG. 1 a rearview of the inventive step in one embodiment showing the right part of the step.

The step or element 10 shown in FIG. 1 comprises a stepping surface 12 with a plurality of parallel grooves 14 and stays 16.

At the forward area of the step or element 10 a seating step 18 extends in a manner known per se which is substantially vertical and curved whereby the forward seating step 18 sufficiently reinforces the forward area of the support surface 12.

Inventively, the rearward area of the step or element 10 has a reinforcement 20 in the form of the truss structure 22. It extends in a uniform manner across the entire width of the step or element 10 even when in FIG. 1 only a portion is represented. The truss structure is comprised of individual truss elements of which three truss elements 24, 26 and 28 are represented in FIG. 1. The truss structure is preferably closed toward the inner side.

The truss elements 24 through 28 have a typical design for a truss structure including slanted stays 30 through 34 whereby the stays 30 through 34 extend alternatingly from an upper left position to a lower right position and from a lower left position to an upper right position. The truss structure 20 is positioned directly adjacent below the stepping surface 12 and extends across the rearward portion of the stepping surface 12, for example, over a fifth of the length of the stepping surface in the direction of travel of the escalator or the moving sidewalk.

The height of each truss element 24 to 28 is considerably less than the height of the seating step 18, for example, slightly more then 30% thereof, whereby, however, the height is selected such that it is greater than the width of each truss element.

Important is the uniform embodiment of all truss elements 24 through 28 over the entire width of the step or element whereby with respect to known solutions a reduced material thickness is possible.

The shown embodiment of a step or element 10 comprises an embedded edge strip 36 which, for safety reasons, is of a different color. It is understood that the inventive solution can also be realized for steps without such edge strips or for edge strips that are attached differently.

Closely below a base support 40 of the truss structure a receiving member 42 for a non-represented axle for supporting the step or element is provided. In a manner known per se an axle 44 extends adjacent to the lower edge of the seating step whereby the thus resulting four-point support ensures safe guiding.

While for the comparatively high seating step 18 a distortion of the axle 44 is less likely, the inventive step or element results in reduced or substantially no distortion in the area of the receiving member 42. The stepping surface 12 itself is manufactured so as to be torsion-resistant so that the required tolerances and precision can be easily ensured during manufacture for the purpose of avoiding collision of the stays 16 with the meshing plates.

The manufacture of the inventive stay or element is performed by injection molding a mixture of polycarbonate and polybutylene terephthalate whereby the here disclosed embodiment has the following composition:

| | |
|---|---|
| polycarbonate | 35% |
| polybutylene terephthalate | 35% |
| fiberglass | 30% |

It is understood that the disclosed composition can be adjusted within a wide range to the respective requirements whereby it is easily possible to improve the light sensitivity by adding respective additives when outdoor operation is desired.

The two chambers formed respectively by the truss elements 24 to 28 and opening to the rear can be produced inventively especially favorably by insertion parts inserted into the injection mold for producing the step or element. They are dimensioned according to the desired hollow spaces. By eliminating slides the distortion can be minimized.

Figure 2:
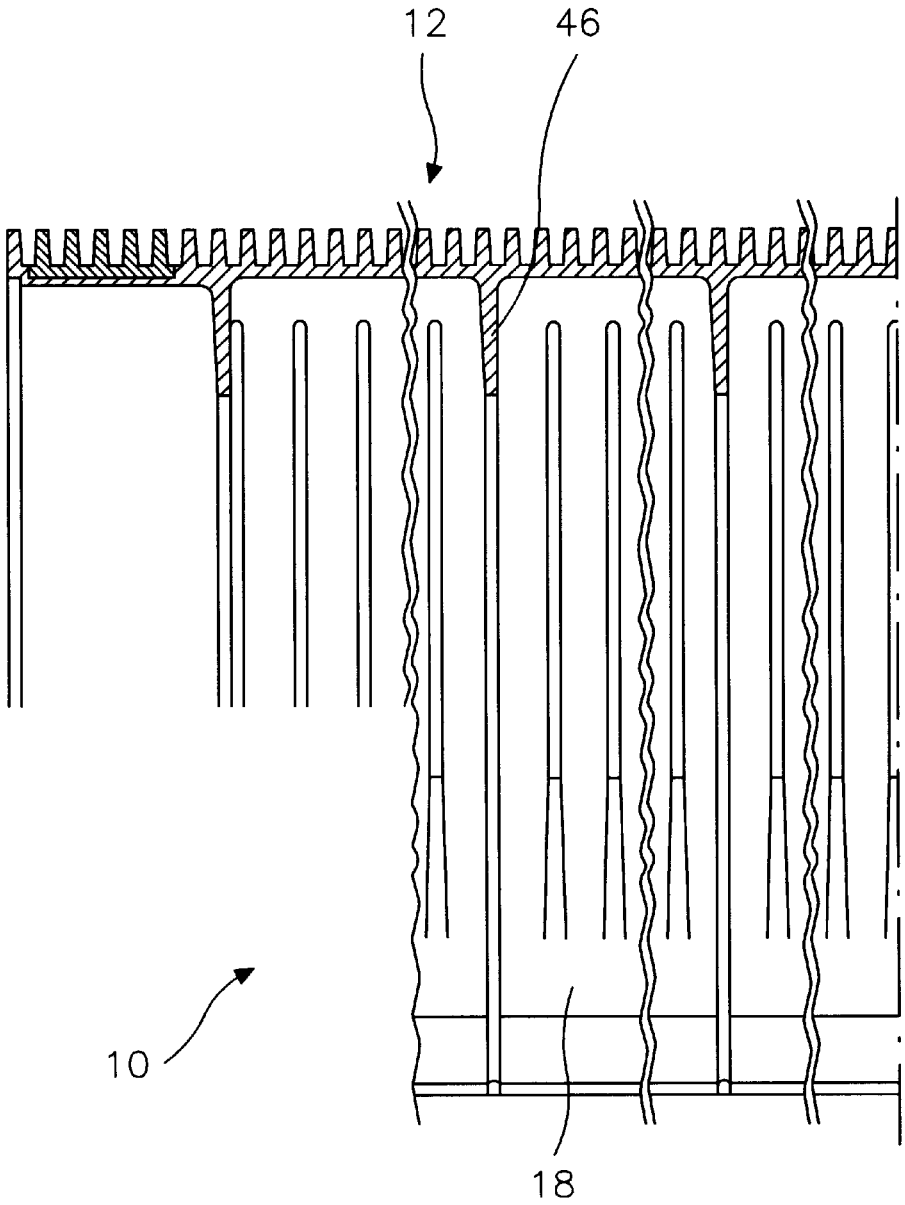
FIG. 2 a section of the step according to FIG. 1, whereby the left part of the step is represented and the section is taken substantially at the center of the step.

FIG. 2 shows in which manner the step or element can be embodied in the front area. Between the seating step 18 and the truss structure 22, reinforcement ribs 46 extend parallel to one another in a uniform spacing, whereby FIG. 2 also shows the comparatively thin wall thickness of the upper wall of the step or element that provides the stepping surface 12.

The reinforcement ribs 46 can be arranged, for example, such that for each truss element 24 through 28 a reinforcement rib 46 is provided whereby it is understood that the disclosed dimensional relations can be adapted within wide ranges to the required specifications.

The inventive element is essentially embodied in the same way. Instead of the seating step a further reinforcement with an inventive truss structure 22 is provided whereby inventively, despite the elimination of the reinforcing seating step, the required tolerances can be maintained surprisingly.

What is claimed is:

1. Step for an escalator or element for a moving sidewalk with a stepping surface having a plurality of stays and grooves extending in the direction of travel of the escalator moving sidewalk, wherein said stepping surface has a reinforcement at a rearward edge that is embodied as a truss structure and extends transverse to the direction of travel across said step or elements, wherein said truss structure is comprised of truss elements having slanted stays which in their orientation with regard to neighboring truss elements alternate and/or are symmetrical to a center of the escalator.

2. Step or element according to claim 1, wherein said step or element is comprised of a fiber glass reinforced mixture of polycarbonate and polybutylene terephthalate.

3. Step or element according to claim 1, wherein said truss structure is formed by a rearwardly open profile having across its forward surface a closed wall.

4. Step or element according to claim 1, wherein said truss structure extends transverse across said step or element over a substantially uniform height directly adjacent to a rear side of said stepping surface below said stepping surface and has a height of ⅕ up to ½ and preferably slightly more than ⅓, of the height of a seating step.

5. Step or element according to claim 1, wherein said truss structure has a base support extending at a uniform spacing from said stepping surface across a width of said step or element.

6. Step or element according to claim 2, wherein a mixing ratio between polycarbonate and polybutylene terephthalate is between 2 to 1 and 1 to 2 and especially is approximately 1 to 1.

7. Step or element according to claim 1, wherein said truss structure is comprised of truss elements whereby a width of said truss elements is 40% to 90%, preferably 60% to 80% and especially approximately 70% of their height.

8. Step or element according to claim 1, wherein said step or element, produced as a unitary part, has a fiberglass contents of 15% to 50%, preferably of 20% to 40%, and especially approximately 30%.

9. Step or element according to claim 8, wherein said fiberglass contents is comprised of fiberglass having a fiber length of more than 1 mm, whereby their length is limited such that the resulting plastic material can be injection molded and/or extruded.

10. Step for an escalator or element for a moving sidewalk with a stepping surface having a plurality of stays and grooves extending in the direction of travel of the escalator or moving sidewalk, wherein said stepping surface has a reinforcement at a rearward edge that is embodied as a truss structure and extends transverse to the direction of travel across said step or elements, wherein respective outermost slanted stays of said truss structure extend from an upper outer position to a lower inner position.

11. Step for an escalator or element for a moving sidewalk with a stepping surface having a plurality of stays and grooves extending in the direction of travel of the escalator or moving sidewalk, wherein said stepping surface has a reinforcement at a rearward edge that is embodied as a truss structure and extends transverse to the direction of travel across said step or elements, wherein said truss structure is comprised of truss elements having slanted stays that are oriented in the same direction or extend in a crossed arrangement.

12. Step for an escalator or element for a moving sidewalk with a stepping surface having a plurality of stays and grooves extending in the direction of travel of the escalator or moving sidewalk, wherein said stepping surface has a reinforcement at a rearward edge that is embodied as a truss structure and extends transverse to the direction of travel across said step or elements, wherein for said step at least one injection point for the plastic material to be injected is at a lower edge of a seating step and wherein for an element at least one injection point is at the base support of said truss structure and that at this location a cross-sectional enlargement for the film attachment by injection is provided.

13. Step for an escalator or element for a moving sidewalk with a stepping surface having a plurality of stays and grooves extending in the direction of travel of the escalator or moving sidewalk, wherein said stepping surface has a reinforcement at a rearward edge that is embodied as a truss structure and extends transverse to the direction of travel across said step or elements, wherein said truss structure is produced by introducing a mold slide from behind into a substantially U-shaped portion that is open to the rear of the injection mold for producing said step or element.

14. Step for an escalator or element for a moving sidewalk with a stepping surface having a plurality of stays and grooves extending in the direction of travel of the escalator or moving sidewalk, wherein said stepping surface has a reinforcement at a rearward edge that is embodied as a truss structure and extends transverse to the direction of travel across said step or elements, wherein an edge strip, which differs especially with respect to the color of the base material of said step or element, is snapped onto an edge portion of said step surface that is without ribs.

15. Step for an escalator or element for a moving sidewalk with a stepping surface having a plurality of stays and grooves extending in the direction of travel of the escalator or moving sidewalk, wherein said stepping surface has a reinforcement at a rearward edge that is embodied as a truss structure and extends transverse to the direction of travel across said step or elements, wherein an edge strip is spaced from a lateral edge of said stepping surface and surrounded by the base material of said step or element and that at least one stay of said stepping surface extends between said edge strip and said lateral edge.

* * * * *

UNITED STATES PATENT AND TRADEMARK OFFICE

CERTIFICATE OF CORRECTION

PATENT NO : 6,039,167
DATED : Mar. 21, 2000
INVENTOR(S) : Jan Vellinga

It is certified that error appears in the above-identified patent and that said Letters Patent are hereby corrected as shown below:

On the title page, insert item [30]:

[30] Foreign Application Priority Data

May 30, 1997 [DE] Germany.....197 22 819.4

Signed and Sealed this

Twenty-fourth Day of April, 2001

*Attest:*

*Attesting Officer*

Nicholas P. Godici

NICHOLAS P. GODICI

*Acting Director of the United States Patent and Trademark Office*